US008348466B2

(12) United States Patent
Plumb et al.

(10) Patent No.: US 8,348,466 B2
(45) Date of Patent: Jan. 8, 2013

(54) LIGHTED MOVING BALL DISPLAY SYSTEM

(76) Inventors: Lloyd Plumb, Woods Cross, UT (US); Lola Plumb, Woods Cross, UT (US)

( * ) Notice: Subject to any disclaimer, the term of this patent is extended or adjusted under 35 U.S.C. 154(b) by 304 days.

(21) Appl. No.: 12/830,921

(22) Filed: Jul. 6, 2010

(65) Prior Publication Data

US 2011/0007510 A1 Jan. 13, 2011

Related U.S. Application Data

(60) Provisional application No. 61/224,535, filed on Jul. 10, 2009.

(51) Int. Cl.
*F21V 33/00* (2006.01)
*F21V 21/00* (2006.01)

(52) U.S. Cl. ..... 362/249.19; 362/564; 362/123; 362/253; 362/249.16; 40/375; 40/406; 40/407; 40/432

(58) Field of Classification Search ..... 362/249.19, 362/564, 654, 123
See application file for complete search history.

(56) References Cited

U.S. PATENT DOCUMENTS

| | | | | |
|---|---|---|---|---|
| 1,974,472 | A | 9/1934 | Seghers | |
| 3,470,338 | A * | 9/1969 | Ahrens | 200/46 |
| 4,249,331 | A * | 2/1981 | Vernon | 40/432 |
| 4,675,575 | A | 6/1987 | Smith et al. | |
| 4,858,086 | A * | 8/1989 | Pietrantonio et al. | 362/123 |
| 5,066,011 | A | 11/1991 | Dykstra et al. | |
| 5,112,055 | A | 5/1992 | Barnhill | |
| 5,316,293 | A | 5/1994 | Hamilton | |
| 5,426,877 | A * | 6/1995 | Lin | 40/406 |
| 5,513,081 | A | 4/1996 | Byers | |
| 5,941,626 | A * | 8/1999 | Yamuro | 362/246 |
| 6,332,282 | B1 * | 12/2001 | Lin | 40/406 |
| 6,428,432 | B1 | 8/2002 | Kachel | |
| 6,666,782 | B1 | 12/2003 | Wu | |
| 6,848,819 | B1 | 2/2005 | Arndt et al. | |
| 6,991,351 | B1 | 1/2006 | Petrick | |
| 7,029,129 | B2 | 4/2006 | Shimada | |
| 7,235,930 | B1 | 6/2007 | Hsu | |
| 7,274,160 | B2 | 9/2007 | Mueller et al. | |
| 7,276,858 | B2 | 10/2007 | Allen | |
| 7,279,809 | B2 | 10/2007 | Janning | |
| 7,603,802 | B2 * | 10/2009 | Oudekerk et al. | 40/375 |

* cited by examiner

*Primary Examiner* — Sikha Roy
(74) *Attorney, Agent, or Firm* — Webb IP Law Group; Jason P. Webb; Danny Y. H. Cheng

(57) ABSTRACT

A lighted moving ball display system configured to provide a visual display, including a plurality of lighted balls; wherein the lighted balls include a light emitting device; a ball power module and a housing. The system includes a medium having a plurality of clear plastic tubes, spirals, tracks, or spouts; wherein the lighted balls moves therethrough. The system also includes a lifting mechanism configured to lift the lighted balls to a top portion of the medium; and a loading mechanism in communication with the collection chamber and configured to load the lighted balls into the lifting mechanism. The system includes a power module configured to provide power to the modules and components of the system. The system further includes a circulation mechanism configured to circulate the lighted balls through the medium; wherein the circulation mechanism includes a pressurized air system configured to project air through the medium during operation.

16 Claims, 9 Drawing Sheets

LIGHTED MOVING BALL DISPLAY SYSTEM

CROSS-REFERENCE TO RELATED APPLICATIONS

This invention claims priority, under 35 U.S.C. §120, to the U.S. Provisional Patent Application No. 61/224,535 to Lloyd Plumb filed on Jul. 10, 2009, which is incorporated by reference herein.

BACKGROUND OF THE INVENTION

1. Field of the Invention

The present invention relates to visual displays, specifically to a lighted moving ball display systems.

2. Description of the Related Art

The Christmas tree is one of the most popular traditions associated with the celebration of Christmas. Normally an evergreen coniferous tree that is brought into a home or used in the open, a Christmas tree is decorated with Christmas lights and colorful ornaments during the days around Christmas. Over the years, artificial Christmas trees have evolved and become popular. Most modern artificial Christmas trees are made from polyvinyl chloride (PVC) or other plastics.

Other gimmicks have developed as well. Fiber optic Christmas trees come in two major varieties; one resembles a traditional Christmas tree. One manufacturer offers "holographic mylar" trees in many hues. Tree-shaped objects made from such materials as cardboard, glass, ceramic or other materials can be found in use as tabletop decorations.

Artificial trees became increasingly popular during the late 20th century. Users of artificial Christmas trees assert that they are more convenient, and, because they are reusable, much cheaper than their natural alternative. Lighting with candles or electric lights (fairy lights) is commonly done and a tree topper, traditionally either an angel or a star, completes the ensemble.

Individual decorations vary widely, typically being an eclectic mix of family traditions and personal tastes; even a small unattractive ornament, if passed down from a parent or grandparent, may come to carry considerable emotional value and be given a place of pride on the tree. Conversely, trees decorated by professional designers for department stores and other institutions will usually have a "theme"; a set of predominant colors, multiple instances of each type of ornament, and larger decorations that may be more complicated to set up correctly. However, new lighting techniques and devices are increasing growing due to consumer demand for new and more colorful lighting displays.

The inventions heretofore known suffer from a number of disadvantages which include being limited in application, being limited in adaptability, being complex, being bulky, and being limited in use.

What is needed is a lighted moving ball display system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available lighted moving ball display systems.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
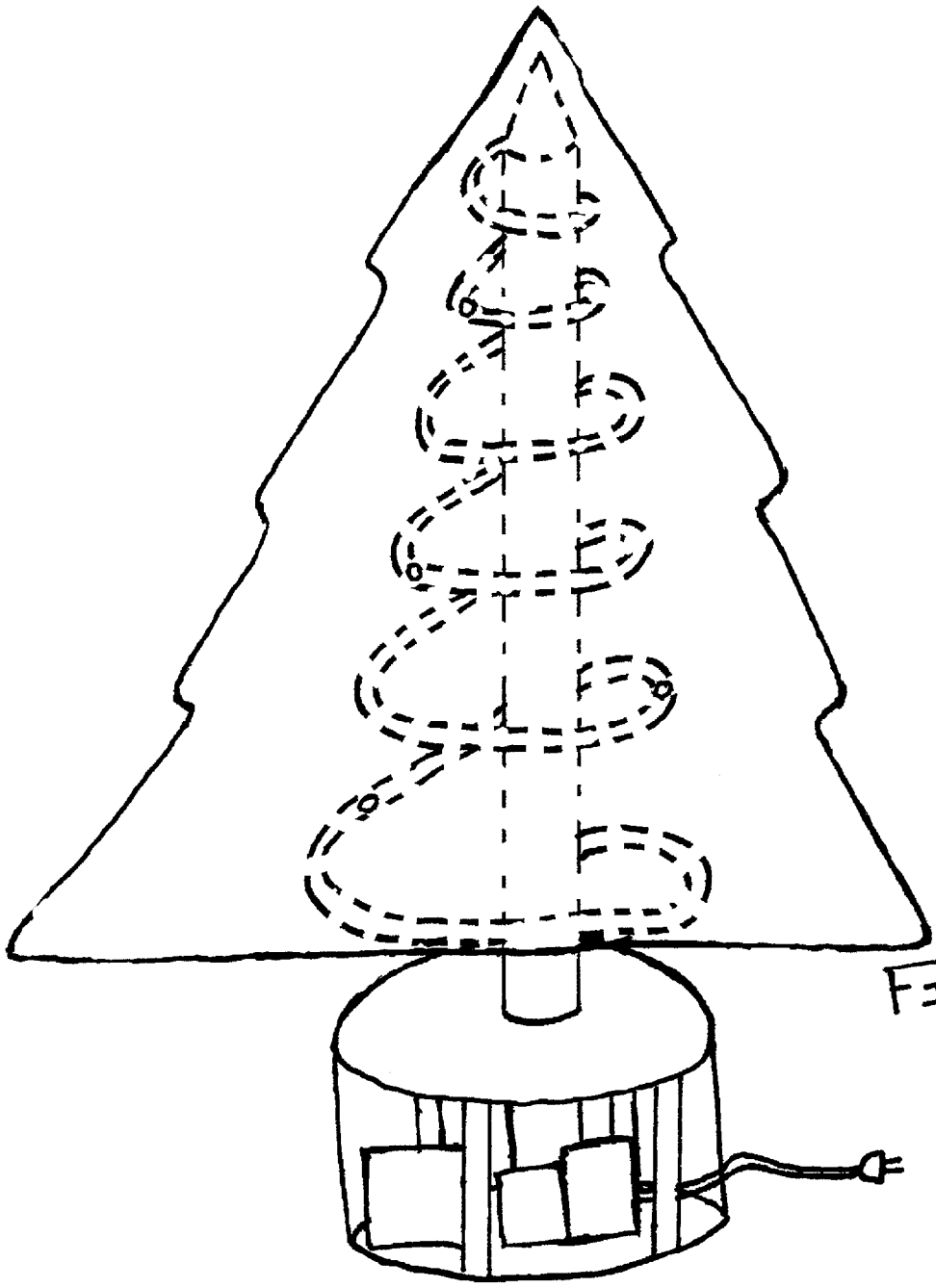
FIG. 1 is a perspective view of a lighted moving ball display, according to one embodiment of the invention.
Figure 2:
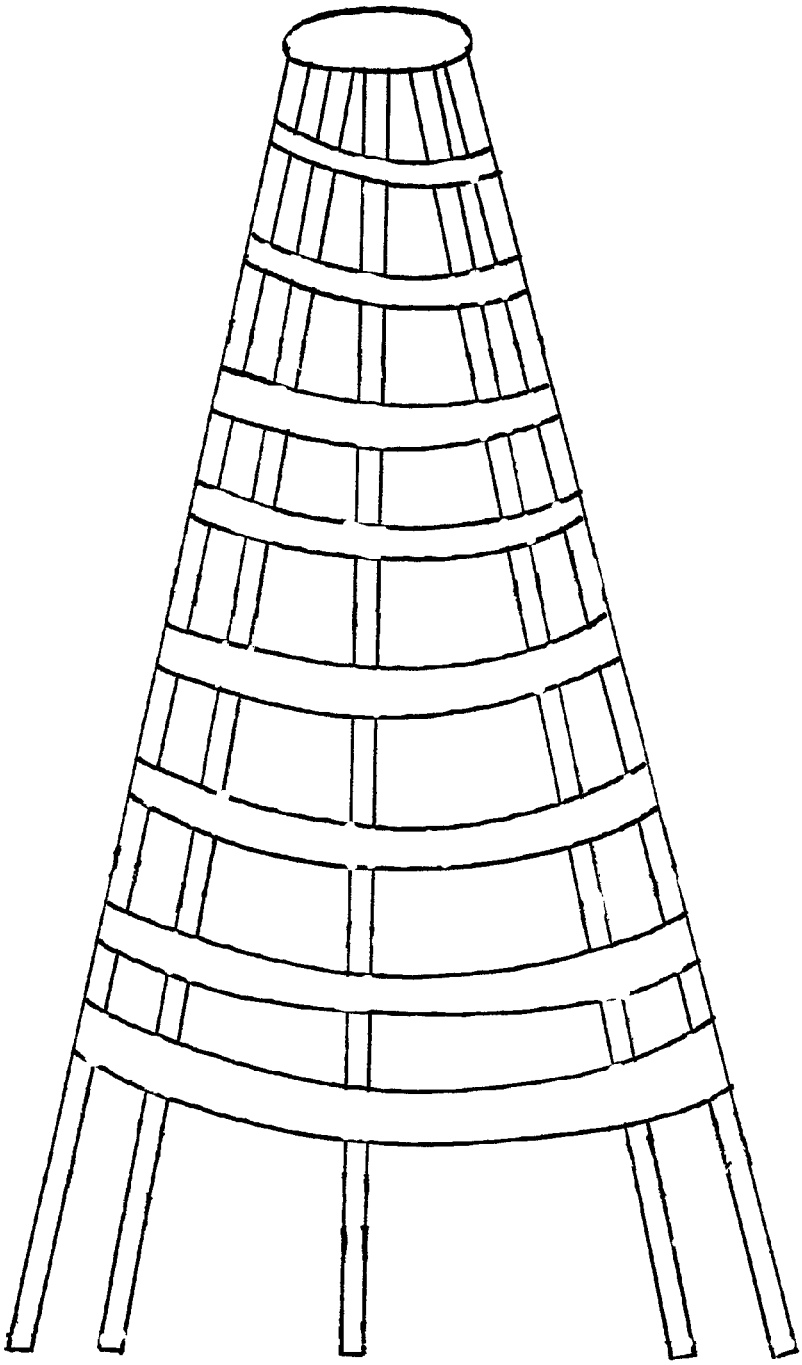
FIG. 2 is an elevational view of a form configured to facilitate bending acrylic tubing for a lighted moving ball display, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Looking to the Figures, there is a lighted moving ball display system configured to provide visual shows, fixtures, fountains, or presentations, according to one embodiment of the invention. The lighted moving ball display system includes a plurality of lighted balls configured to move through a medium. The medium includes a plurality of clear plastic tubes, spirals, tracks, spouts, or other structures configured to direct lighted objects along a desired trajectory. The lighted moving ball display system also includes a lifting mechanism configured to lift the plurality of lighted balls to a top portion of the medium. As illustrated in FIG. 1, the medium is disposed within a Christmas tree. The medium may be designed to resemble a Christmas tree and/or any other decorative display such as but not limited to: statues, fountains, light shows, signs, and etc.

There may be an electrical track coupled within a clear tube. The lighted balls may include an electrical contact pad or an electrical grid coupled to LEDs inside the lighted balls and/or other systems/devices configured to provide power to light emitting devices of the balls such that the balls may emit light at least at some point during travel through the display. The illustrated system includes lighted balls that roll inside the tube/track, and are configured to light up. Electrical energy may be transferred from the track through the pads or grid, wirelessly from an RF power emission source, internally through batteries, or by other methods of providing power to the balls, to light the lights (likely LEDs) within the lighted balls.

Figure 3:
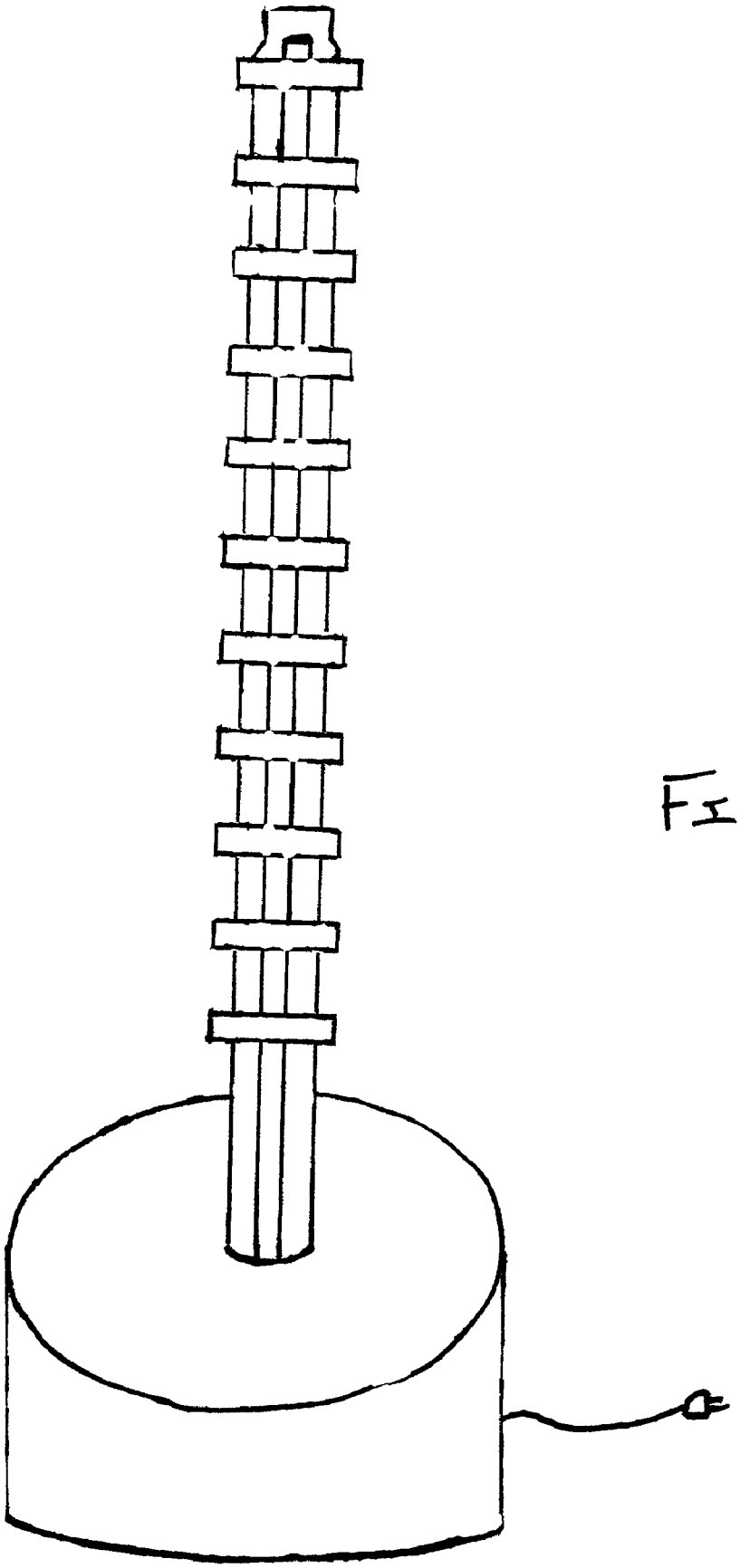
FIG. 3 is a perspective view of a portion of a lighted moving ball display, according to one embodiment of the invention.
Figure 4:
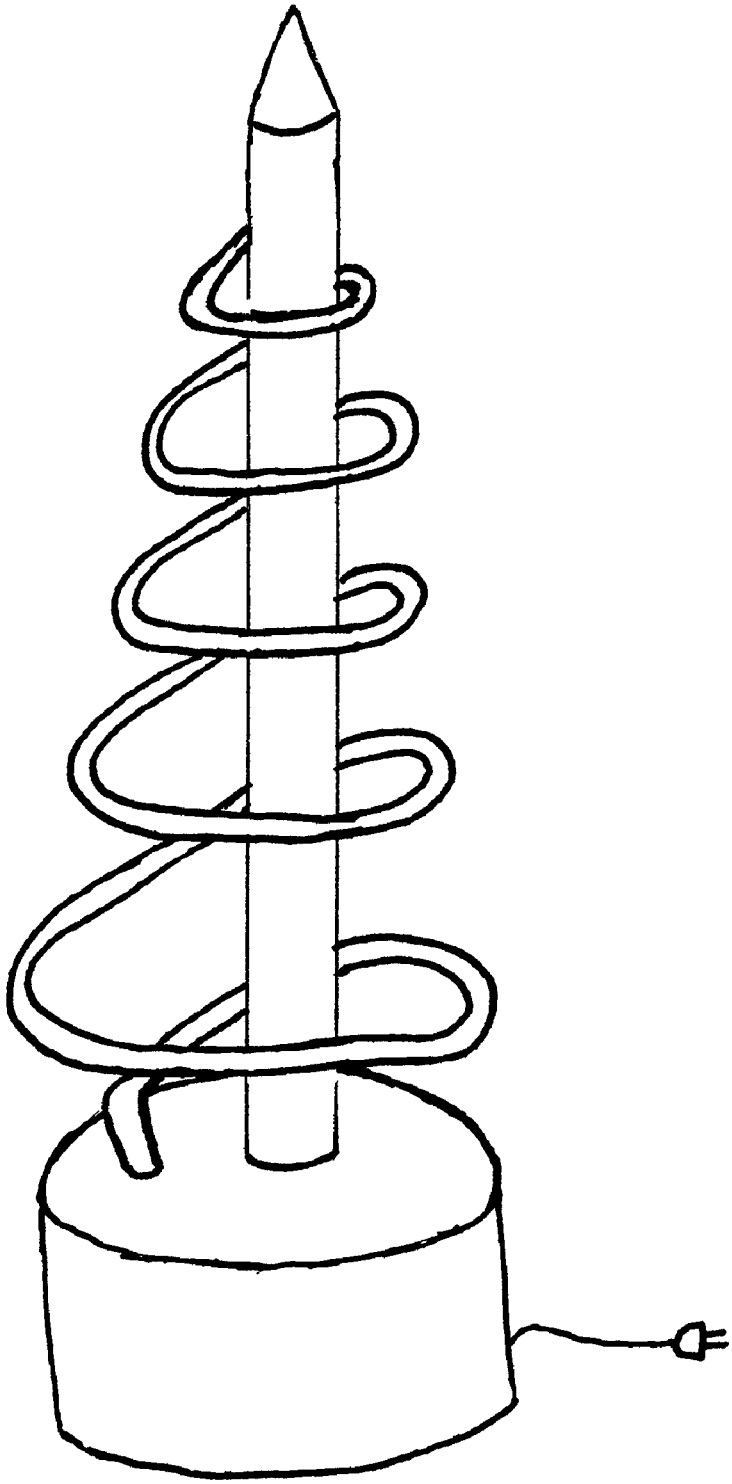
FIG. 4 is a perspective view of a lighted moving ball display, according to one embodiment of the invention.

As illustrated in FIG. 3, the lighted moving ball display system includes a lifting mechanism configured to transport the lighted balls to a top portion of the medium, thereby allowing gravity to move the lighted balls through the medium, to a bottom portion of the medium. Other alternative or cooperative systems may be used to cause the lighted balls to move about the display including but not limited to air/water pressure, magnetism, springs, and the like. FIG. 4 illustrates a lighted moving ball display system including a power module configured to provide power to the components and modules of the lighted moving ball display system.

Figure 5:
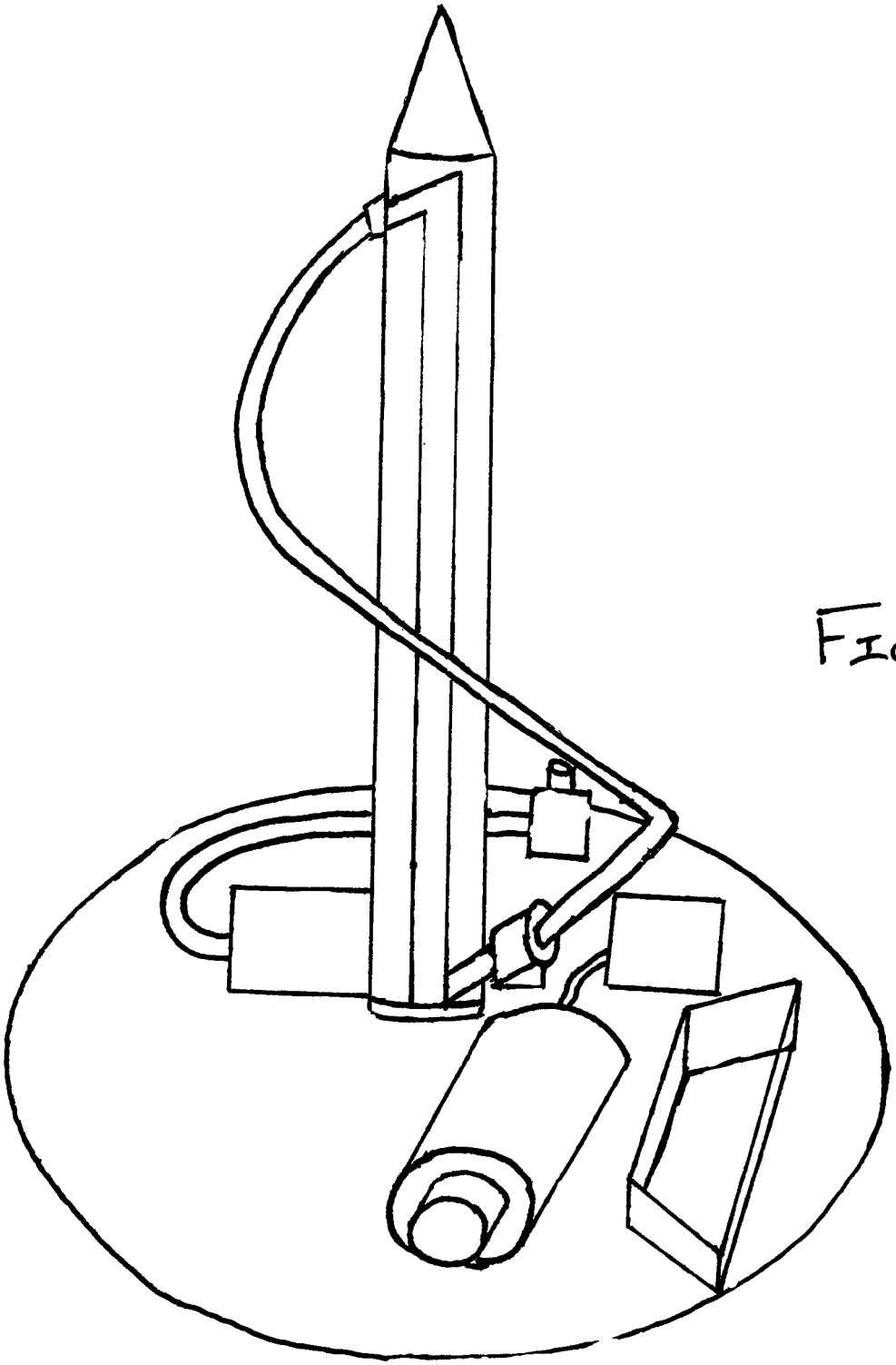
FIG. 5 is a perspective view of a lighted moving ball display, according to one embodiment of the invention.

FIG. 5 illustrates a lighted moving ball display system having a motor configured to motorize the lifting mechanism of the lighted moving ball display system and the circulation mechanism, the circulation mechanism may be an air pressure mechanism configured to assist the lighted balls move through the medium. The lighted moving ball display system also includes a drum configured to load the lighted balls into the lifting mechanism. In addition, the lighted moving ball display system includes a collection bin configured to collect the lighted balls after the lighted balls have travelled through the medium. There is shown a collection module coupled to a loading module powered by a power module and functionally coupled to a lifting module such that balls loaded into the loading module may be lifted by the lifting module. The lifting module is also powered by the power module and is controlled by the control module. The lifting module deposits the balls into the circulation module wherein the balls and circulated through the display system. The balls are received by the lifting module but may be diverted to the collection module for removal from the device.

In operation a plurality of lighted balls are loaded into the loading module and lifted by the lifting module to the circulation module where they are then displayed for effect. The balls end their trip at the lifting module and are recycled through the system. Accordingly, the display provides a continuous effect of moving lighted balls until interrupted.

Figure 6:
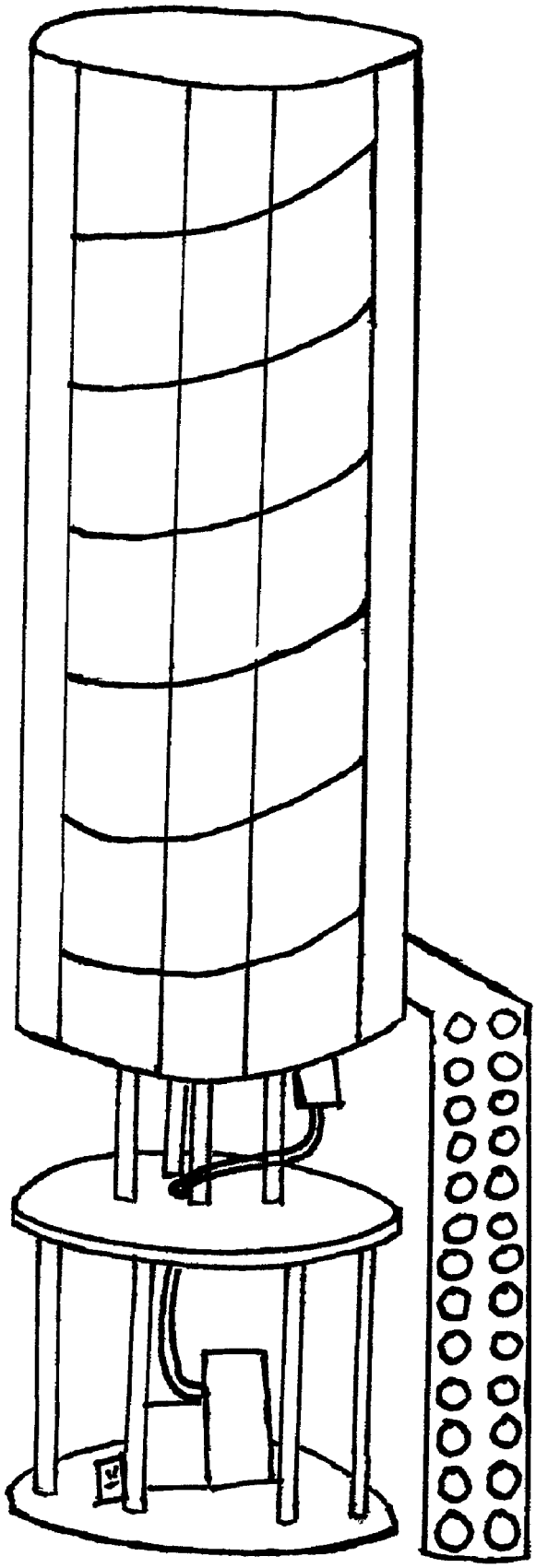
FIG. 6 is an elevational view of a lighted moving ball display, according to one embodiment of the invention.

As illustrated in FIG. 6, the lighted moving ball display system is configured in a barbershop pole according to one embodiment of the invention. The lighted moving ball display system includes a protective casing configured to protect the components, mechanism, and modules of the lighted moving ball display system. It is envisioned that the lighted moving ball display system may be configured in a variety of configurations, designs, structures, displays, presentations, shows, exhibits, etc., and still perform its intended function.

Figure 7:
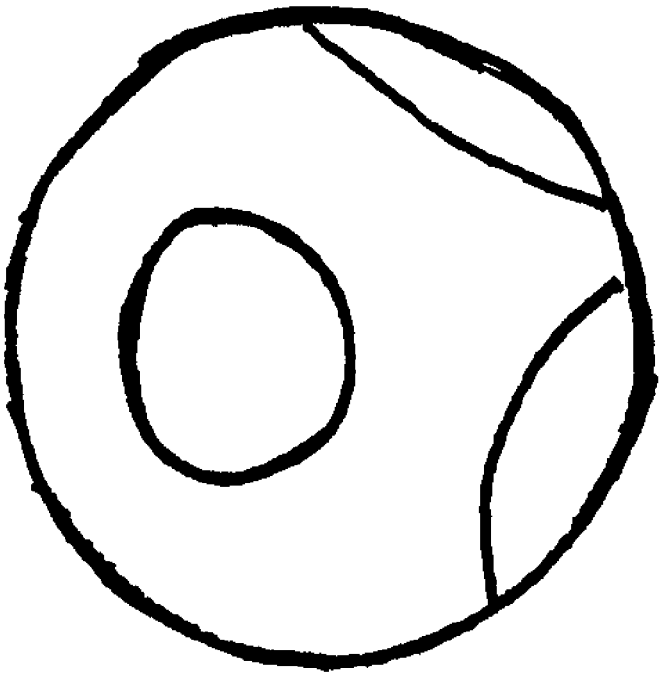
FIG. 7 is a top plan view of a lighted ball of a lighted moving ball display, according to one embodiment of the invention.

FIG. 7 illustrates a lighted ball of a lighted moving ball display system, according to one embodiment of the invention. The illustrated lighted ball includes a plurality of electrical pads coupled to LEDs inside the lighted balls. The lighted balls roll inside the tube, on the track, and are configured to light up. The electrical energy is transferred from the track through the pads or grid, to light the LEDs within the lighted balls. In one embodiment, the lighted balls may include batteries, capacitors and/or other power storage devices that may store a reserve of power during a lift sequence.

Figure 8:
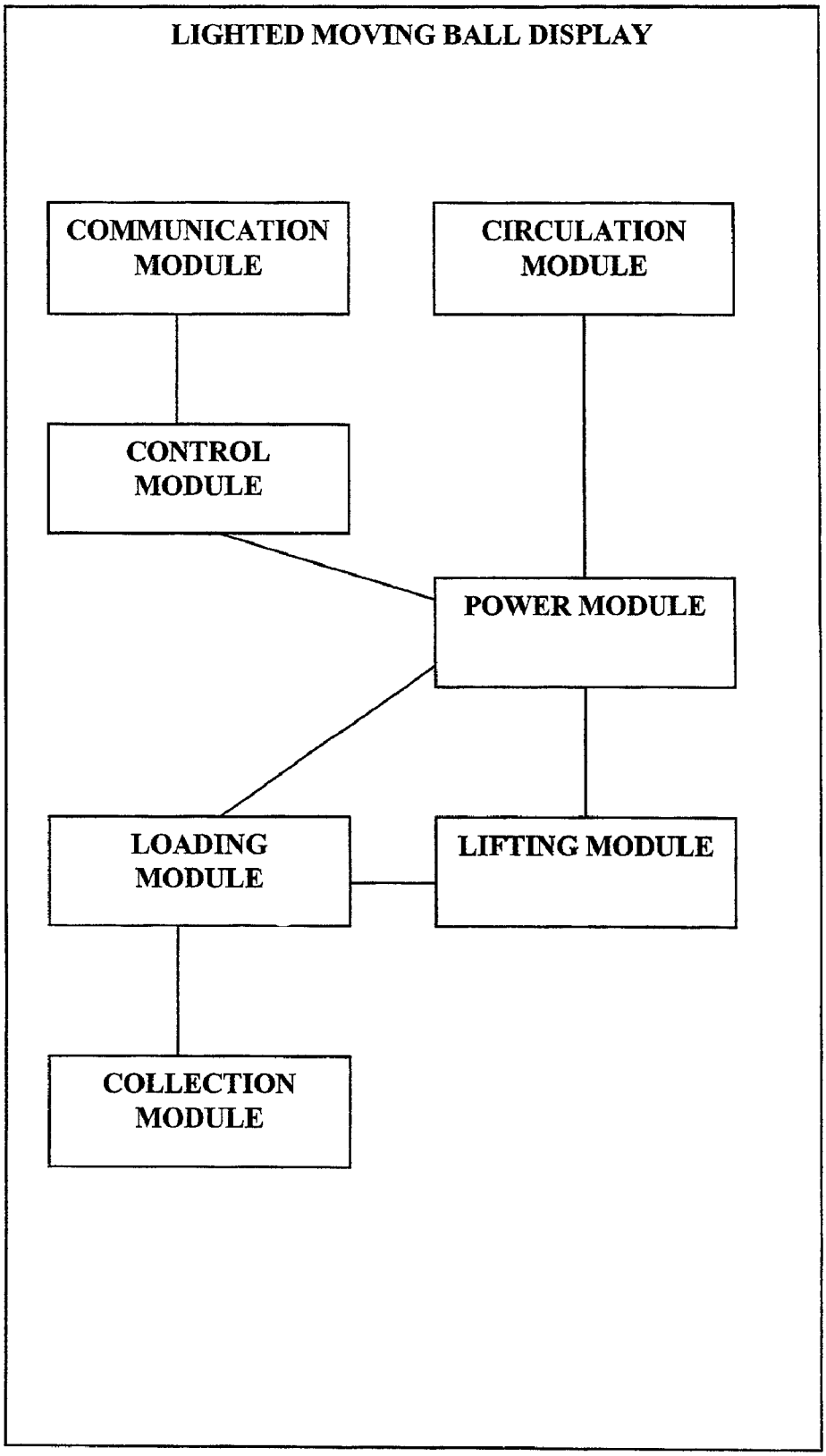
FIG. 8 is a block diagram of a lighted moving ball display, according to one embodiment of the invention.

FIG. 8 is a block diagram of a lighted moving ball display system, according to one embodiment of the invention. The lighted moving ball display system includes a power module configured to provide power to the modules and components of the lighted moving ball display. The lighted moving ball display system also includes a control module configured to control aspects of the lighted moving ball display, such as, but not limited to: timing, color configuration, lighting configuration, speed configuration, etc., and operation of the components and modules of the lighted moving ball display system. The lighted moving ball display system includes a circulation module. In one example the circulation module includes a track and a display medium. The medium is configured to decoratively associate with the track; wherein a plurality of lighted balls roll through the medium, on the track. The lighted moving ball display system includes a loading module configured to store the plurality of lighted balls and load the lighted balls into a lifting module, when in operation. The lifting module is configured to lift the plurality of lighted balls to a top portion of the display; wherein the plurality of lighted balls are configured to roll through the medium from the top portion of the display to a bottom portion.

The lighted moving ball display system also includes a collection module configured to collect the plurality of lighted balls after the lighted balls roll through the medium. The collection module may be in communication with the loading module, wherein the plurality of lighted balls collects into the collection module and then is moved to the loading module to continue the display. Furthermore, the lighted moving ball display system includes a communication module configured to send/receive data from the display module to a network.

A power module may include one or more transformers, batteries, safety circuits, switches or other electrical components or devices for changing, controlling, conditioning, storing, or otherwise providing power having desired characteristics. Such devices are well known in the art.

A control module may include logic circuitry, switches, interfaces, and/or controls according to the desired control of the device and such may be interfaced as appropriate with other modules in order to serve such control purposes. Such may include PLC systems, simple switches, software control interfaces, remote control interfaces, and/or physical devices configured to alter operation of the display, such as but not limited to levers, binary tube channel selection devices, selectable tube blockers, doors, and the like.

A circulation module may include a medium, a track, and/or other systems, structures, and devices configured to provide for desired display and/or circulation of the lighted balls. Non-limiting examples include: tracks, rails, fluid jets, reservoirs, chambers, tubes, pumps, launchers, funnels, nets, decorative members, decorative displays, and the like.

Figure 9:
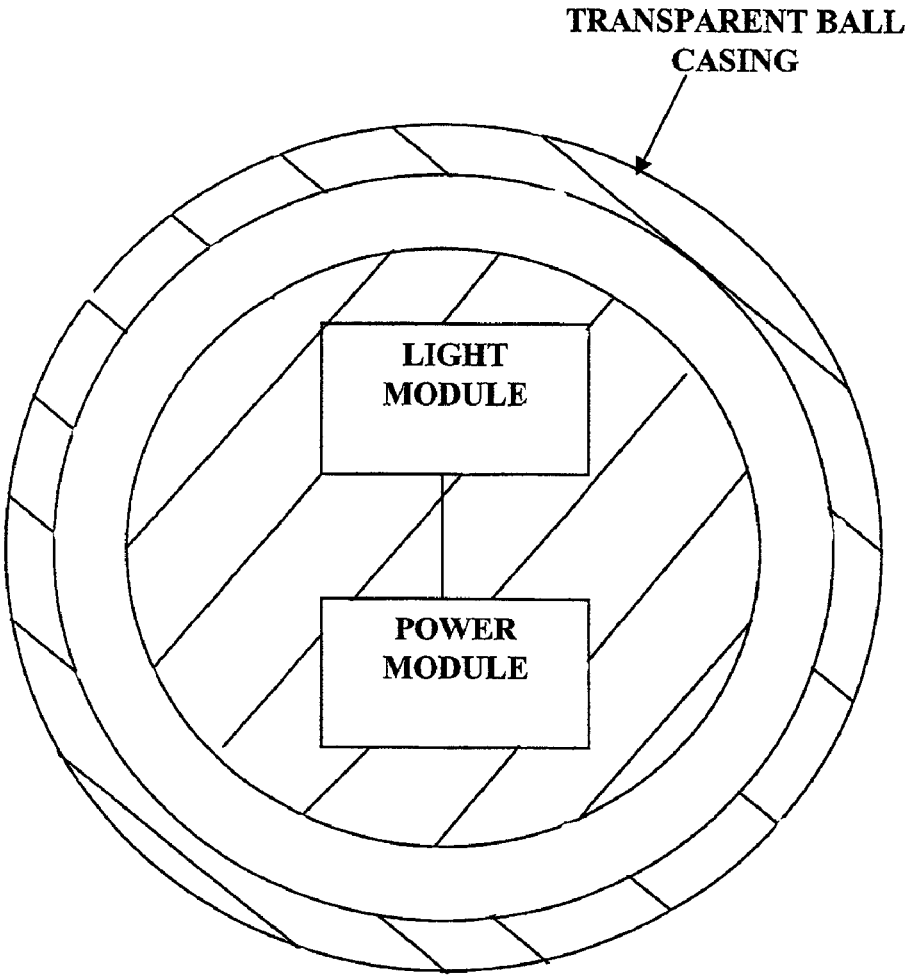
FIG. 9 is a cross sectional view of a lighted ball of a lighted moving ball display, according to one embodiment of the invention.

FIG. 9 is a cross sectional view of a lighted ball of a lighted moving ball display system, according to one embodiment of the invention. The illustrated lighted ball includes a protective transparent/translucent casing configured to allow light to escape therefrom. The illustrated lighted ball also includes a light module configured to produce light coupled to a power module configured to supply the light module with needed power. Each lighted ball includes a power module in electrical communication with the light module and configured to provide power thereto.

EXAMPLES

In one non-limiting example, a collection module may include a selectably closable aperture for receiving balls from the circulation module and a collection chamber for holding received balls as well as a connection with a lifting module for recirculating the balls through the display.

In one non-limiting example, a loading module includes a selectably closable aperture for receiving balls from an exterior of the device and a collection chamber for holding received balls as well as a connection with a lifting and/or collection module configured to facilitate distribution of the inserted balls through the display.

In one non-limiting example, a lifting module may include one or more devices configured to lift a lighted ball including but not limited to a chain or screw driven lift mechanism powered by one or more motors.

In one non-limiting example, a communication module may include a device, such as but not limited to a transceiver, a wireless network card, a IR receiver, a Ethernet card, and/or other devices configured to send and/or receive communication. Such may be in communication with a control module such that the display may be operated remotely.

In one non-limiting example, a protective casing may include a glass, plastic, silicon, or other similar material shaped into a sphere or other desired shape configured to cooperate with the display in generating motion of the lighted ball.

In one non-limiting example, a light module may include an LED or other light emitting device.

In one non-limiting example, a power module may include a battery, a wireless power receiver, or other device configured to provide power to the light module.

In one embodiment of the invention, there is a lighted moving ball display system including a plurality of electrical tracks, similar to a model railroad or a slot car track. The lighted balls include electrical contact pads or grids connected to LEDs disposed inside the lighted balls. The lighted balls are configured to roll and the LEDs are configured to light, as the contact pads or grids make contact with the electrical tracks. In addition, an electrical track is coupled to a spiral lift mechanism having one side of the track being a spiral with a metallic surface, and the other side of the track on the inside of the tube. When the lighted balls are lifted, the lighted balls are configured to stay lit while being lifted.

According to another embodiment of the invention, the lighted moving ball display system is configured to power the lighted balls through induction. High frequency alternating current is configured to flow through a primary transformer coil placed strategically next to tubes or another medium where the lighted balls roll by, such that the lighted balls have internal secondary coils connected to LEDs, thus inducing current in the secondary coils inside the lighted balls and causing the LEDs to light. Primary coils could be incorporated around a lifting mechanism tube, as well, to light the lighted balls when being lifted.

According to yet another embodiment of the invention, the lighted moving ball display system is configured to include wireless power transmission technology. One non-limiting example of a wireless power transmission technology, may be a Wireless Power Platform Transmitter Modules transmit RF power to Wireless Power Platform Receiver Modules manufactured by Powercast LLC. This embodiment would require the lighted balls to be a large enough ball size to accommodate adequate space for a receiving antenna inside each lighted ball.

In yet another embodiment of the invention, the lighted moving ball display system is configured to include technology having wireless power transmission. One non-limiting example may be a wireless power transmission module developed by Fulton Technologies Inc. The data transfer capability of the wireless power transmission module is configured to send data to decoder chips inside the lighted balls to change the color of LEDs. Multi-color LEDs are disposed inside the lighted balls to achieve this.

In still yet another embodiment of the invention, the lighted moving ball display system is configured to include a tiny gyroscope electrical generator disposed inside each lighted ball and configured to create electrical current to light the LEDs inside the lighted balls while they are in motion. The lighted balls include a medium to create a unique visual effect as they move through the medium. The lighted moving ball display includes a clear plastic spiraled tubes arranged in the shape of a Christmas Trees, as illustrated in the Figures, The Christmas tree is configured to provide unique visual effects, thus replacing traditional lighting methods for Christmas Trees. Clear tubing is configured to any shape desired for the lighted balls to move throughout the lighted moving ball display. As illustrated in the Figures, the lighted balls move throughout a spiral clear tubing with a wide base disposed about the bottom and coming towards a peak at the top of the Christmas tree.

In still yet another embodiment of the invention, the lighted moving ball display system is configured to provide unique non-seasonal visual effects. The lighted moving ball display system includes a liquid filled fountain having lighted balls configured to be shot into the air by water pressure and drop into collecting ponds. Air pressure could also be used to shoot the lighted balls into the air, thus creating a lighted moving ball cannon. The concept of placing lighted moving balls inside neon lighting tubes has also been considered. For example, red neon lighting tube may include a blue lighted ball inside of them for an extremely unique effect. Other types of media may be incorporated to create a lighted moving ball displays, show, fixture, fountain, or presentation.

The lighted moving ball display system also includes a circulation mechanism to move the lighted balls through a selected medium. Air pressure may be configured to lift the lighted balls to the top of the display. A series of solenoids and sensors may be configured to move each lighted ball into a chamber, wherein an air valve is configured to acelerate the lighted balls to be shot through a tube. The lighted moving ball display system also includes a loading mechanism configured to load one lighted ball at a time into a chamber and detect the presence of the lighted ball with a photo sensor to activate a solenoid air valve that is configured to shoot the lighted ball to the top of the display.

In yet another embodiment of the circulation mechanism, there is a chain lift mechanism configured to lift the lighted balls to the top of the display. The lift mechanism includes a series of motorized rollers and sensors to detect the presence of a lighted ball, in order to load one lighted ball, at a time, onto each lighted ball catch on the chain lift mechanism. In addition, the circulation mechanism may be a spiral lift configured to lift the lighted balls to the top of a display. The spiral lift mechanism includes a single motor and no sensors or solenoids. Furthermore, the circulation mechanism may be a water pressure lift configured to lift the lighted balls to the top of the display. A water pump is configured to allow the lighted balls to be pumped through the medium with water. Lighted ball cannons are configured to shoot lighted balls over audiences at concerts and other events. The lighted ball cannon include a control module configured to control the velocity of the projected lighted balls to maintain safety during the display. In addition, the lighted balls of the lighted ball cannon include a soft outer surface, such as a clear gel material, to protect people from bodily harm. The lighted balls may also be manually thrown into the air to spectators, at concerts or sporting events.

In yet another embodiment of the invention, the lighted balls are configured in a threaded arrangement and disposed on a track. One non-limiting example a threaded arrangement may be a beaded necklace configuration disposed within a medium. The threaded arrangement includes an electrified wire configured to provide a power source.

According to one embodiment of the invention, there is a loading mechanism configured to load lighted balls into the circulation mechanism. The loading mechanism includes a drum; wherein the lighted balls are disposed within the drum for storage until operation of the display. The loading mechanism includes a motor configured to rotate the drum. The lighted balls are loaded into a tube, from the drum, and into the lifting mechanism. The lighted balls are moved to a top of the display and configured to roll through the medium.

The lighted moving ball display system also includes a solenoid configured to divert the lighted balls that are returning to the lifting mechanism, into a collecting chamber or receptacle or back to a drum. The receptacle includes a drum that is snapped into place, to collect the lighted balls. The drum is configured to be selectably removable for storage. The lighted balls may be configured to be sold separately, inside a drum, to provide different color schemes or variations.

The following is an example of a system according to one nonlimiting embodiment of the invention: There may be a mechanism that loads one ball at a time into a chamber and detects the presence of the ball with a photo sensor to activate a solenoid air valve that shoots the ball to the top of the display.

The following is an example of a system according to one nonlimiting embodiment of the invention: There is a chain lift that incorporates a structure for automatically loading and unloading the balls into the display. Balls are loaded and unloaded in the demonstration prototypes to turn the balls on for operation and off for storage. Balls may be removed from the display while it is in storage. This also allows the balls to be easily changed. Since LEDs of any color available may be placed inside balls, any color pattern of balls may be loaded into the display. For example, if all red-lighted balls were desired one day and blue-lighted balls were desired the next day, this could easily be achieved. Two, three, four, or five colors could be loaded in any combination of colors desired. Separate colors could be loaded into each individual spiral in multi-helix displays or other configurations with multiple tubes, tracks or spouts.

The following is an example of a system according to one nonlimiting embodiment of the invention: There may be a corkscrew lift built in a barbershop pole configuration and/or a small tabletop Christmas Tree. LEDs may be wired to multiple copper pads glued into the surface of a hollow break apart clear plastic ball. The ball may be injected with hot glue to form a solid sphere. Stress supports may then be glued to a clear acrylic tube. Bass guitar tuning pegs and adjustable height rollers may be mounted at places on the supports. Flat welding wire may then be wrapped around the tuning pegs and tightened to form two tracks. These tracks may be connected to the output of a low voltage AC transformer. Since AC power is being provided to the LEDs the polarity doesn't matter. No rectification is needed to light LEDs in this manner. The corresponding LEDs will light no matter which two pads on the ball make contact with the tracks.

The following is a plurality of examples of a system according to one nonlimiting embodiment of the invention, under the moniker Chroma Comets:

1. The initial Chroma Comets™ product offerings will look similar to the lighted spiraled Christmas Trees that people have been placing on their lawns for a number of years. Instead of stationary LED lights, the Chroma Comets™ Christmas Trees will have balls with electrical contact pads connected to LEDs inside the balls that are lifted to the top through the tree trunks on corkscrew lifts and will roll down electrical tracks inside clear spiraled tubes to power the LEDs. This process would be continuously repeated.
   a. They can be made with one spiral or helix that the balls roll down, a double helix, triple helix, quadruple helix, or other multi-helix configurations.
   b. They can be made with or without any branches.
   c. They can be a couple of feet tall or several feet tall.
   d. They could be other shapes such as cylindrical spirals, or columns, wavy, even look like upside down Christmas trees, or almost any other shape.
   e. Large spiraled Chroma Comets™ Lighted Moving Ball Displays could be installed around amusement part rides such as the Big Shot Tower Ride on top of the Stratosphere Hotel in Las Vegas for added visual effects for thrill seekers.
2. A partnership could be formed with Creative Machines Inc. to add Chroma Comets™ Lighted Moving Balls to their rolling ball machines (ballmachinesculptures.com) such as Newton's Daydream at the Clark Planetarium in Salt Lake City (clarkplanetarium.org).

3. The wireless power transmission technology developed by Powercast (powercastco.com) and/or Fulton Innovation (ecoupled.com) could be incorporated into future renditions of Chroma Comets™ Lighted Moving Ball Displays or proprietary wireless power transmission technology could be developed.
   a. Wireless power transmission technology will make it possible to create many other variations of Chroma Comets™ Lighted Moving Ball Displays
      i. Water Fountains, wherein Chroma Comets™ Lighted Moving Balls are propelled into the air by pressurized water.
         1. Lucas Congdon (a CEO Space Member) of Lucas Lagoons in Sarasota, Fla. has expressed an interest in Chroma Comets™ Water Fountains.
      ii. Ball Cannon and Bell Shaped Receptacle pairs shoot Chroma Comets™ Lighted Shooting Balls back and forth over audiences using air pressure, spring mechanisms, or another propulsion method.
         1. Chroma Comets™ Lighted Shooting Ball Displays could replace dangerous pyrotechnics used by rock bands.
      iii. Chroma Comets™ Lighted Moving Ball Aquariums that circulate Lighted Balls through the water using various methods.
         1. Balls are lifted to the top and then they sink back to the bottom.
         2. Buoyancy causes the balls to float to the top, then they are transported to the bottom, and released to float back to the top.
         3. Water spouts inside the aquariums cause the balls to move up and down or side to side at random.
      iv. Chroma Comets™ Lighted Shooting Balls are shot into the air and high current flash LEDs are activated by the use of timers, radio signals, or altitude sensors to create electronic fireworks.
         1. High current flash LEDs are presently being developed that are expected to approach the power levels of xenon flash tubes with the advantages of low voltage operation, higher efficiency and extreme miniaturization.
         2. Chroma Comets™ Lighted Shooting Balls could replace dangerous pyrotechnics used by rock bands and performers.
      v. Chroma Comets™ Lighted Moving Balls flowing through clear tubing embedded in floors, walls, ceilings, and/or signage.
         1. Air or water pressure could be used to propel the balls.
         2. Any desired pattern could be created as long as tubing curves still allow balls to flow through them including cursive writing such as the Coca-Cola logo.
         3. Chroma Comets™ Lighted Moving Balls could replace chase lighting outside casinos and other buildings.

According to one embodiment of the invention, there is a hollow ball that looks like the earth, floating on a cushion of air. There may be a ring with air jets pointed at a slight angle, to cause the ball to slowly rotate in the air, replicating the rotation of the earth. A Powercast Power Harvester module may be in the center of the ball powering one or more high brightness white LEDs. Fiber optic strands may be attached to the LED(s) and may terminate on the surface of the globe, replicating the lights of the cities on the earth. The planets and the sun may have patterns that look like their surfaces which may be backlit. The back light may also simulate the night and day conditions. Some of the planets like Jupiter and the sun may include a mini-projector or projectors inside that may project an image on the surface of the translucent balls, which may replicate their storms, such as the great red spot on Jupiter. The hollow globes may be positioned in a very large dark room as they float on their air jets to replicate the solar system. The walls, floor, and ceiling may be painted black and include small lights positioned on them to replicate the stars. The Chroma Comets Lighted Moving Balls System may displace moving balls through the air in planned trajectories which may be caught by strategically placed ball receptacles. The balls may then be transported through hidden tubes back to the ball cannons to repeat the process.

The following are examples of benefits and/or contexts that may be associated with one or more embodiments of the invention: improve home values, entertainment, dance floors, lamps, signs, shows, fixtures, presentations, ornaments, displays, ambiance, floating in the air, fountains, healing aquariums, fireworks substitute.

The following are examples of options, variations, benefits and the like that may be associated with one or more of the embodiments described herein: free moving balls shoot out of water/air spouts, balls may float and/or sink to varying degrees at varying times and may include structures for effectuating such (controlled bladders and the like), lasers and/or fog may be utilized in association with a display, toy sized balls, balls too large to swallow, balls instead of fish in an aquarium and may be designed to simulate fish colors/patterns, safe balls shot into an audience during a concert, and/or color changing balls, system intake may sort by size or color or other characteristic to control which balls travel through which transport mechanisms, intake sorting may be dynamic and/or associated with a choreographed display plan, and/or wireless transmission/reception may be separated by color or other ball characteristic.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a lighted ball having a plurality of electrical contact pads, one skilled in the art would appreciate that the display includes an internal gyroscope that generates electricity inside the lighted balls as they spin, and wireless RF or induction power transmission. Rechargeable batteries may be included in any of these methods to keep the lighted balls lit when not being energized externally or by motion.

Additionally, although the figures illustrate a lifting mechanism, a plurality of lighted balls, a motor, a power module, a medium, a drum, a circulation module, one skilled in the art would appreciate that the modules, components, and mechanisms of the display may vary in size, shape, design, color, length, width, height, configuration and still perform its intended function.

It is expected that there could be numerous variations of the design of this invention. An example is that the lighted moving ball display is incorporated into casinos, amusement parks, malls, nightclubs, medical offices and other places where the masses gather. Custom lighted moving ball displays, shows, fixtures, fountains, and presentations may be configured in many different types of locations.

The following are non-limiting examples of various mediums/contexts wherein the lighted ball display may be implemented: fountain (home and garden, vegas-style, indoor, fondue, etc.), stage, pool, cruise ship, lighting system of a building, tower, works of art, toys, roller coasters, and etc. The following are non-limiting embodiments of modifications/variations on the lighted balls: resembling planets, resembling crystals, resembling fireworks, resembling ice cubes, resembling projectiles, and the like.

Ball transport may be effected in various ways, including but not limited to: gravity, chain lifts, corkscrew lifts, air pressure, water pressure, buoyancy, air cannons, combinations thereof, and the like.

Ball lighting may be accomplished by batteries, electrical contact pads on balls in contact with electrical leads on tracks, wireless power transmission and reception, rechargeable batteries, motion activated internal power generation, chemical power generation, combinations thereof and the like.

Finally, it is envisioned that the components of the device may be constructed of a variety of materials, such as but not limited to plastic, plastic composite, metal, metal alloys, glass, textile, rubber, rubber composite, and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A lighted moving ball display system configured to provide a visual display, comprising:

a) a plurality of lighted balls;

b) a medium having a plurality of clear plastic tubes, spirals, tracks, or spouts; wherein the plurality of lighted balls moves therethrough;

c) a lifting mechanism configured to lift the plurality of lighted balls to a top portion of the medium;

d) a power module configured to provide power to modules and components of the system; and e) a circulation mechanism configured to circulate the plurality of lighted balls through the medium.

2. The system of claim 1, wherein the medium is in a Christmas tree configuration.

3. The system of claim 1, wherein the circulation mechanism includes a pressurized air system configured to project air through the medium during operation; wherein the plurality of lighted balls move therethrough.

4. The system of claim 1, wherein the plurality of lighted balls include:

a) a light emitting device;

b) a ball power module configured to power the light emitting device; and c) a housing configured to secure the light emitting device and the ball power module, therein.

5. The system of claim 1, wherein the lifting mechanism includes:

a) a collection chamber in communication with the medium and configured to collect the plurality of lighted balls after moving through the medium;

b) a loading mechanism in communication with the collection chamber and configured to load the plurality of lighted balls into the lifting mechanism; and c) a lifting device in communication the loading mechanism and the collection chamber; wherein the lifting device includes lifting means, to lift a plurality of lighted balls to a top of a medium.

6. The system of claim 1, wherein the medium is liquid.

7. The system of claim 1 further comprising a control module in communication with the power module and configured to provide controls to the circulation mechanism and the lifting mechanism.

8. The system of claim 7, further comprising a communication module in communication with the control module and configured to provide remote access and remote controls to the system.

9. A lighted display system comprising:

a) a ball module including a power module and a light module housed in a protective casing configured to permit light to pass therethrough; and b) a circulation module configured to receive the ball module and cause the ball module to travel therethrough in a manner allowing the ball module to be displayed.

10. The system of claim 9 further comprising a medium; wherein the medium is in a Christmas tree configuration.

11. The system of claim 9, wherein the circulation module includes a pressurized air system configured to project air through a medium during operation; wherein the ball module move therethrough.

12. The system of claim 9 further comprising a lifting mechanism; wherein the lifting mechanism includes:

a) a collection chamber in communication with the medium and configured to collect the plurality of lighted balls after moving through the medium;

b) a loading mechanism in communication with the collection chamber and configured to load the plurality of lighted balls into the lifting mechanism; and c) a lifting device in communication the loading mechanism and the collection chamber; wherein the lifting device includes lifting means, to lift a plurality of lighted balls to a top of a medium.

13. The system of claim 10, wherein the medium is liquid.

14. The system of claim 9 further comprising a control module in communication with a power module and configured to provide controls to a circulation mechanism and a lifting mechanism.

15. The system of claim 14, further comprising a communication module in communication with the control module and configured to provide remote access and remote controls to the system.

16. A lighted moving ball display system configured to provide a visual display, comprising:

a) a plurality of lighted balls; wherein the plurality of lighted balls include:

a1) a light emitting device;

a2) a ball power module configured to power the light emitting device; and a3) a housing configured to secure the light emitting device and the ball power module, therein;

b) a medium having a plurality of clear plastic tubes, spirals, tracks, or spouts; wherein the plurality of lighted balls moves therethrough; wherein the medium is in a Christmas tree configuration;

c) a lifting mechanism configured to lift the plurality of lighted balls to a top portion of the medium; wherein the lifting mechanism includes:

c1) a collection chamber in communication with the medium and configured to collect the plurality of lighted balls after moving through the medium;

c2) a loading mechanism in communication with the collection chamber and configured to load the plurality of lighted balls into the lifting mechanism; and c3) a lifting device in communication the loading mechanism and the collection chamber; wherein the lifting device includes lifting means, to lift a plurality of lighted balls to a top of a medium;

d) a power module configured to provide power to the modules and components of the system;

e) a circulation mechanism configured to circulate the plurality of lighted balls through the medium; wherein the circulation mechanism includes a pressurized air system configured to project air through the medium during operation; wherein the plurality of lighted balls move therethrough;

f) a control module in communication with the power module and configured to provide controls to the circulation mechanism and the lifting mechanism; and g) a communication module in communication with the control module and configured to provide remote access and remote controls to the system.

* * * * *